United States Patent [19]

Bourdon et al.

[11] 4,368,038

[45] Jan. 11, 1983

[54] REFRACTORY PADS FOR WALKING BEAM FURNACES

[75] Inventors: Jean-Marc Bourdon, Neuilly-sur-Seine; Jean-Claude Hugues, Le Thor; Marc Esnoult, Sorgues, all of France

[73] Assignee: Societe Europeenne des Produits Refractaires, Neuilly-sur-Seine, France

[21] Appl. No.: 257,261

[22] Filed: Apr. 24, 1981

[30] Foreign Application Priority Data

May 6, 1980 [FR] France ..... 80 10072

[51] Int. Cl.[3] ..... F27D 5/00; F27D 3/02

[52] U.S. Cl. ..... 432/253; 432/234; 432/258

[58] Field of Search ..... 432/253, 258, 122, 234, 432/235; 198/774, 775, 776

[56] References Cited

U.S. PATENT DOCUMENTS

| | | | |
|---|---|---|---|
| 3,015,478 | 1/1962 | Buckholdt et al. | 432/235 |
| 4,293,299 | 10/1981 | Gaddes | 432/234 |

FOREIGN PATENT DOCUMENTS

| | | | |
|---|---|---|---|
| 2346826 | 3/1975 | Fed. Rep. of Germany | 432/122 |
| 1325350 | 3/1963 | France . | |
| 2038621 | 1/1971 | France . | |
| 1241009 | 7/1971 | United Kingdom . | |
| 1342891 | 1/1974 | United Kingdom | 432/234 |

*Primary Examiner*—John J. Camby

*Attorney, Agent, or Firm*—Watson, Cole, Grindle & Watson

[57] ABSTRACT

The invention relates to walking beam furnaces. It concerns a skid pad or lug for walking beam furnaces, which comprises a body made of an oxide-based refractory substance and a shell made of refractory metal alloy surrounding the periphery of the body, means being provided to prevent detachment towards the top of the body in relation to its shell.

8 Claims, 6 Drawing Figures

REFRACTORY PADS FOR WALKING BEAM FURNACES

BACKGROUND OF THE INVENTION

1. Field of the Invention

The invention relates to walking beam furnaces and more particularly to refractory skid pads or lugs for such furnaces.

2. Prior Art

For several years, cooled walking beam furnaces have tended to replace pusher furnaces for the reheating of steel slabs, blooms or billets, by reason, in particular of their higher manufacturing capacity, their good reliability and their economic advantages.

In walking beam furnaces, the load to be heated (slabs, blooms or billets) passes from mobile beams to fixed beams successively, without friction, by controlled placing on and removing from spaced apart skid pads or lugs, integral with the walking beams and projecting over the top of the walking beams. Since the beams consist of a metallic tube (of a diameter of approx. 130–220 mm) cooled internally by a circulation of water and a relatively thick insulating refractory lining (approx. 60 mm) encasing the tube, it would be advantageous for the skid pads or lugs to be as high as possible so that their upper surface is at a temperature as close as possible to that of the inner surface of the load. Equally, the higher the skid pads or lugs, the less the effect of shadow, which the skid pads and their insulating lining may have on the heating of the load by lower lateral burners, need be feared.

However, the pads or lugs presently employed, which are made of an alloy of 50% cobalt, 30% chrome and 20% iron, have a tendency to become flattened, owing to an insufficient resistance to creep, after a few months of operation when their height exceeds a certain value (90 mm approx.), changing from an initial cylindrical shape to that of a mushroom, due to the fact that the stresses able to be supported by the metal lessen when the operational temperature of the metal increases, which is the case when the height of the skid pads or lugs is increased. For this reason, the height of present skid pads is in the range of 70–90 mm. In order to remedy this disadvantage, it has been proposed to employ an alloy rich in nickel instead of the above-mentioned alloy, but the results obtained, to the knowledge of the Applicant, have not been fully satisfactory.

Thus there is a need for skid pads or lugs of relatively large height for walking beam furnaces which perform better than the skid pads or lugs presently used and which are cheaper than these latter.

SUMMARY OF THE INVENTION

The present invention aims to fulfill this need by providing a new skid pad or lug for walking beam furnaces.

The invention relates to a skid pad or lug for walking beam furnaces comprising a body made of an oxide-based refractory substance, and a shell made of a refractory metal alloy surrounding the periphery of the body, means being provided to prevent detachment towards the top of the body in relation to its shell.

Preferably, the body projects slightly at its upper part in relation to the shell.

According to a preferred embodiment, the skid pad or lug comprises in addition a metallic reinforcement embedded in the body made of a refractory substance.

By "skid pad or lug", elements of a generally circular cross-section are meant as well as of a generally square, rectangular or other cross-section.

Means to prevent detachment of the body must be provided in order to prevent the body from being detached from its shell, under the effect of adhesion with the load to be reheated. It has in fact been observed that such an undesirable phenomenon might occur in the case of bodies merely flanged in a cylindrical shell. Anti-detachment means may consist in giving the shell a cross-section which gets smaller from its base to its top, for example to give the shell a truncated or pyramid shape. By way of a variation, the shell might be given a corrugated shape or be provided with projections on the internal surface of the shell designed to sustain the body against any force aiming to detach it from its shell.

The oxide-based refractory substances which may be used are any fused cast refractory substances which have a very low creep under the operational conditions of the skid pads (temperature of the order of 1300° C. and compression forces of the order of 2.5 $N/mm^2$, for example) are insensitive to oxidation, resistant to corrosion by iron oxide, thus of low porosity, and have a low tendency to adhere with the calamine present on the surface of the load to be reheated. In general, fused cast refractory substances used to make the hearths of pushing furnaces may be employed. Non-restrictive examples of such substances are as follows:

- a fused cast refractory substance, the chemical composition of which, by weight, is approximately 73% $Al_2O_3$, 5% $ZrO_2$, 20% $SiO_2$, 0.5% $TiO_2$, 0.3% CaO, 0.5% $Fe_2O_3$ and 0.7% $Na_2O$, and the cristallographic composition of which, by weight, is 43% corundum, 5% zirconia, 37% mullite and 15% vitreous phase. This substance is available on the market under the trademark MAGMALOX ® and is used mainly for the construction of hearths for pushing furnaces;
- the fused cast refractory substances, disclosed in French Pat. No. 2 295 930 or U.S. Pat. No. 4,139,394 for lining hearths of pushing furnaces and the chemical composition of which, by weight, is 10% to 28% $ZrO_2$, 3% to 12% $SiO_2$, 60% to 80% $Al_2O_3$, 0.3% to 1.5% $Na_2O$, up to 5% in total $Fe_2O_3$, $TiO_2$, CaO and MgO, with the proviso that the weight ratio $SiO_2/Na_2O \leqq 16$, and the cristallographic composition of which, by weight, is 60% to 80% corundum, 10% to 28% zirconia and 5% to 19% vitreous phase making up at least 99% of the composition, the amount of zirconia + 2.5 (vitreous phase) being between 33% and 57.5%.

Instead of fused cast refractories, refractory concretes and sintered refractory substances with a high alumina content might also be used, in particular the refractory concretes described in U.S. Pat. No. 4,111,711, particularly those containing chromium oxide.

Nowadays, however, the use of fused cast refractory substances to form the body of skid pads is preferred.

The shell is encomposed of a refractory metal alloy having a good mechanical resistance at high temperature. Non-restrictive examples of alloys which are suitable are refractory steels such as the following:

0.5% C, 26.5% Cr, 48.5% Ni, 6.25% W and iron to make it up to 100%;

0.4% C, 25% Cr, 20% Ni and iron to make it up to 100%.

Preferably, the skid pad according to the invention comprises, in addition, a metallic base on which the refractory body rests, in order to distribute the compression forces exercised on the body over a greater surface of the cooled walking beam.

The skid pads or lugs according to the invention have heights of at least approx. 70 mm, preferably 100–150 mm in order to minimise the thermal transfer from the load to be reheated towards the cooled skid pads. Such a height, which represents a considerable increase in relation to the 70–90 mm of skid pads or lugs of the prior art, is made possible owing to the low level of creep at high temperature of the refractory substances used to make the body of skid pads according to the invention. MAGMALOX ® for example, resists pressures of the order of 30 $N/mm^2$ at 1,300° C., while the compression forces exercised on pads by the loads to be reheated are of the order of 2.5 to 3 $N/mm^2$. Moreover, owing to the fact that the oxide-based fused cast refractory substances have a much lower thermal conductivity than the metal alloys used to make pads in the prior art, the thermal transfer from the load to be reheated towards the cooled walking beams is considerably reduced, which allows homogeneity of the improved reheating to be obtained.

The metallic reinforcement, optional but preferred, embedded in the body, is intended to improve the resistance of the body to mechanical and thermal shocks, refractory substances being relatively susceptible to these shocks. Equally, in the case of breakage of the body, this reinforcement tends to hold together the pieces of the body, which, otherwise, may be detached from the skid pad, for example due to sticking with the calamine of the loads to be reheated. The metallic reinforcement may have varying configurations. It may, for example, be composed of a cross-shaped metallic insert or be in the form of wings integral with a central pole. It may also be composed of wings integral with the shell and distributed over the internal surface of the latter, in which case the metallic reinforcement may simultaneously fulfill the role of an anti-detachment means.

The pads or lugs according to the invention may be easily affixed to the walking beams supporting them by soldering of the base of the shell to the walking beams.

The manufacture of a skid pad or lug according to the invention, when a fused cast refractory substance is employed to form the body of the pad, may be carried out by pouring the molten refractory substance into the shell resting on its base and leaving it to solidify there, a feedhead being provided on the top of the mold-forming shell in order to localize the pipe cavity there. After cooling, the solidified part corresponding to the feedhead is cut, the cutting line being situated slightly above the top of the shell.

Of course, the refractory body might also be cooled separately and introduced into the shell later.

Preferably, the refractory body is rested on a metallic base which spreads the stress over a larger area of the cooled walking beam.

BRIEF DESCRIPTION OF THE DRAWINGS

The description which follows, made with reference to the drawings will make the invention better understood. In the drawings.

DETAILED DESCRIPTION OF THE INVENTION

Figure 1A:
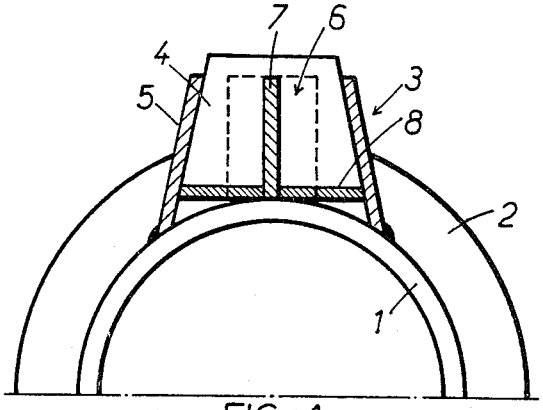
FIGS. 1*a* and 1*b* are vertical and horizontal cross-sectional views respectively of a pad according to the invention.
Figure 1B:
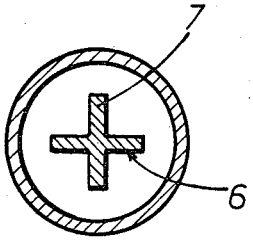

In FIGS. 1*a* and 1*b*, part of a walking beam consisting of a metallic tube 1 cooled by circulating water and a refractory thermal insulation 2 can be seen. This walking beam supports on its upper part a skid pad, designated by the general reference 3, consisting of a body 4 made of a fused cast refractory substance, a shell 5 made of refractory steel of a generally truncated cone shape surrounding the body and of an insert 6 made of refractory steel consisting of a cross-shaped piece 7 soldered at its bottom to a round base 8 made of steel, the cross-shaped piece being embedded in the refractory substance of the body. The skid pad 3 is affixed by welding of the base of the shell 5 to the tube 1, and the body projects slightly, at its upper part, in relation to the shell. By way of example, the skid pad may be 120 mm high and have a diameter of 110 mm at its top and of 130 mm at its base. The projection of the body in relation to the shell may be of the order of 2 mm. The truncated cone shape of the shell prevents the body from being detached.

Figure 2A:
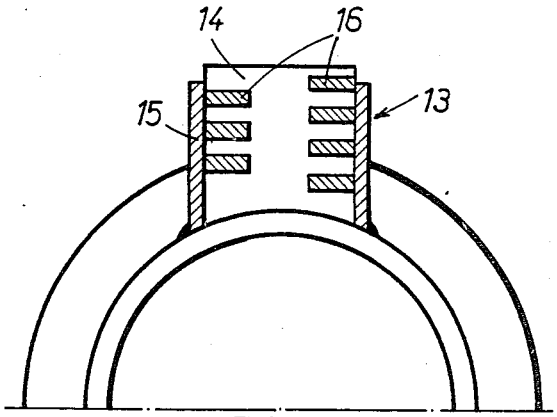
FIGS. 2*a* and 2*b* are vertical and horizontal cross-sectional views respectively of another pad according to the invention.
Figure 2B:
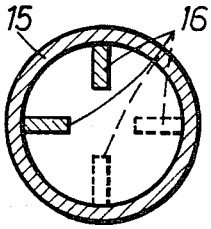

In FIGS. 2*a* and 2*b*, which illustrate a variation of the embodiment of the skid pad according to the invention, a skid pad can be seen, designated by the general reference 13, consisting of a body 14 made of a fused cast refractory substance and surrounded by a shell 15 made of refractory steel of generally cylindrical shape. The shell 15 has on its interior surface a plurality of wings 16 made of refractory steel, for example in the form of groups of 3 or 4 wings distributed at 90° from one another as is shown in FIG. 2*b*, the wings of opposite groups being out of phase with each other in the direction of height as FIG. 2*a* shows.

These wings are embedded in the fused cast refractory substance during manufacture of the pad and prevent any detachment of the body during operation.

Figure 3A:
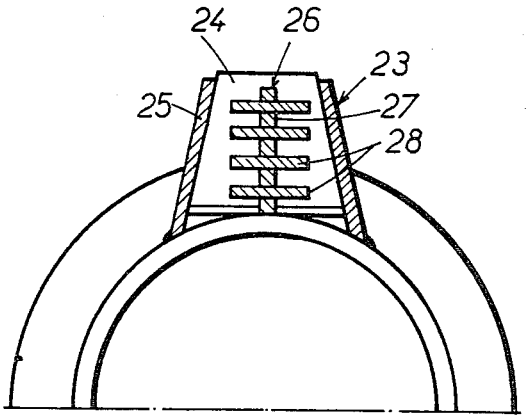
FIGS. 3*a* and 3*b* are vertical and horizontal cross-sectional views of still another pad according to the invention.
Figure 3B:
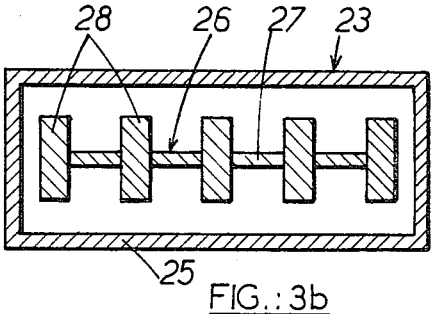

FIGS. 3*a* and 3*b* illustrate still another type of skid pad according to the invention. This skid pad, designated by the general reference 23, is of rectangular shape in horizontal cross-section and consists of a body 24 made of a refractory fused cast substance, a shell 25 made of refractory steel in the general shape of a truncated pyramid with a rectangular base, and an insert 26 made of refractory steel and comprising a rectangular plate 27 having wings 28 distributed over its surfaces.

The type of skid pad shown in FIGS. 3*a* and 3*b* is particularly suited to the reheating of narrow components (billets) which necessitate an almost continuous support along the beam.

We claim:

1. A skid pad or lug for walking beam furnaces, comprising a body made of a refractory oxide-based substance and a shell made of a refractory metal alloy surrounding the periphery of the body, and means to prevent detachment of the body and shell from one another.

2. A skid pad or lug according to claim 1, further comprising a metallic reinforcement member embedded in the body.

3. A skid pad or lug according to claim 1, wherein the shell has the shape of a cone trunk or a pyramid trunk.

4. A skid pad or lug according to claim 1, wherein the shell is of cylindrical shape and is provided on the internal surface thereof, with projecting elements.

5. A skid pad or lug according to claim 2, wherein the metallic reinforcement member is cross-shaped.

6. A skid pad or lug according to claim 2, wherein the metallic reinforcement member comprises a central winged element.

7. A skid pad or lug according to claim 1, which is at least 100 mm high.

8. A skid pad or lug according to claim 1, further including a metallic base on which the body rests.

* * * * *